US007278932B2

(12) United States Patent
Kasashima et al.

(10) Patent No.: US 7,278,932 B2
(45) Date of Patent: Oct. 9, 2007

(54) GOLF BALL DIMPLE ARRANGEMENT METHOD

(75) Inventors: Atsuki Kasashima, Chichibu (JP); Katsunori Sato, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 61 days.

(21) Appl. No.: 10/913,391

(22) Filed: Aug. 9, 2004

(65) Prior Publication Data

US 2005/0032590 A1 Feb. 10, 2005

(30) Foreign Application Priority Data

Aug. 8, 2003 (JP) ..... 2003-289840

(51) Int. Cl.
*A63B 37/12* (2006.01)

(52) U.S. Cl. ..... 473/383

(58) Field of Classification Search ..... 473/378–385
See application file for complete search history.

(56) References Cited

U.S. PATENT DOCUMENTS 5,156,404 A * 10/1992 Oka et al. ..... 473/382
6,234,917 B1 * 5/2001 Asakura ..... 473/378
6,346,054 B1 2/2002 Shimosaka et al.
6,540,625 B2 * 4/2003 Sajima ..... 473/383
2002/0034990 A1 * 3/2002 Sajima ..... 473/378
2003/0134695 A1 * 7/2003 Kasashima ..... 473/378

FOREIGN PATENT DOCUMENTS

JP 2000-070413 A 3/2000

* cited by examiner

*Primary Examiner*—Raeann Trimiew
(74) *Attorney, Agent, or Firm*—Sughrue Mion Pllc.

(57) ABSTRACT

A method for arranging dimples on a golf ball involves the steps of previously drawing a plurality of imaginary lines connecting one pole and the equator on one hemisphere to equally divide the hemispherical surface into a plurality of spherical isosceles triangle regions; arranging a number of dimples within a pair of spherical isosceles triangle regions such that the dimples in the triangle regions are in axial symmetry with respect to the imaginary line; rotationally moving the arranged dimples about the ball axis; and arranging dimples on the other hemisphere such that they are in point symmetry with the dimples as moved on the one hemisphere with respect to the ball center.

4 Claims, 12 Drawing Sheets

GOLF BALL DIMPLE ARRANGEMENT METHOD

CROSS-REFERENCE TO RELATED APPLICATION

This non-provisional application claims priority under 35 U.S.C. section 119(a) on Patent Application No. 2003-289840 filed in Japan on Aug. 8, 2003, the entire contents of which are incorporated herein by reference.

TECHNICAL FIELD

This invention relates to a golf ball having improved aerodynamic symmetry and a method for arranging dimples on a golf ball.

BACKGROUND ART

A plurality of dimples are arranged on the surface of a golf ball for the purpose of reducing the air resistance of the ball in flight. From the standpoint of further improving the aerodynamic symmetry so that the ball may exert consistent flight performance independent of the point of impact, it is desirable to arrange the dimples on the golf ball surface as uniformly as possible.

Known approaches for the uniform arrangement of dimples on the golf ball surface include the use of spherical polyhedral arrangement patterns such as spherical icosahedral, spherical dodecahedral and spherical octahedral arrangement patterns as described, for example, in JP-A 2000-70413. For instance, the spherical icosahedral arrangement pattern is derived by assuming the golf ball surface to be a spherical icosahedron defining twenty triangular units, arranging dimples appropriately within each triangular unit in a good balance, and expanding them over the entire spherical surface.

Generally, golf balls are manufactured by injection molding. The injection mold consists of a pair of mold halves mated along a parting line which is in alignment with one great circle, known as equator, of the golf ball being molded therein. If it is desired to lay some dimples across the equator of the golf ball, the mold must be provided with dimple-forming protrusions across the parting line. This complicates the fabrication of the mold. It is then a common practice to avoid the design of disposing dimples across the equator of the golf ball. However, if no dimples are formed across the equator of the golf ball, the golf ball has an endless land formed along its equator, which means that the spherical polyhedral arrangement is distorted or disordered at this position.

Aside from the above-discussed concept of spherical polyhedral arrangement, a sort of polyhedral arrangement is also known as shown in FIGS. 10 to 12. In this method, an equator and a plurality of reference longitudes extending between a pair of poles divide the spherical surface into spherical triangles, and dimples are arranged within each spherical triangle as a reference.

FIG. 10 is a plan view of a prior art golf ball 5 having dimples of the polyhedral arrangement, as viewed from above one pole. FIG. 11 is an elevational view of the ball as viewed from above the equator. In the golf ball 5, six reference longitudes 52, depicted by dashed lines, extend from one pole 51 to the other pole 51 and are equally spaced. These six reference longitudes 52 and the equator 53 divide the spherical surface into twelve spherical triangle regions. A number of dimples 54 are arranged within each spherical triangle region such that the dimples in two adjacent spherical triangle regions sharing one side are in axial symmetry with respect to that boundary line. The same applies to the opposing hemisphere delimited by the equator.

With such a dimple arrangement, those dimples in opposite equator-adjoining portions are juxtaposed side by side as best shown in FIG. 11. The arrangement of dimples which are juxtaposed in pairs in a strip-like area straddling the equator is often considered unfavorable to an esthetic appearance.

The esthetic appearance of dimple arrangement may be improved if the dimple arrangement center line which is in alignment with each reference longitude 52 which is used as a reference in arranging dimples in each triangle region is shifted a predetermined distance between opposite hemispheres after dimples were arranged. FIG. 12 is an elevational view of a prior art golf ball 6 having dimples of such modified polyhedral arrangement, as viewed from above the equator. In the golf ball 6, dimple arrangement center lines 62, 62 on opposite hemispheres are shifted, in a rotational direction about an axis passing a pair of poles 61, 61, by a predetermined distance 6*d*, expressed as a shift or distance along the equator 63. Then, those dimples in opposite equator-adjoining portions are juxtaposed alternately or in zigzag. As a result, the esthetic appearance of the golf ball is improved.

However, arranging dimples with reference longitudes shifted can invite a degradation of the point symmetry of dimple arrangement with respect to the center of the golf ball, that is, a degradation of the symmetry of dimple arrangement, leading to a lowering of flight performance. Additionally, such a dimple arrangement adds to the manufacturing cost of golf balls for the reason described below.

When a golf ball of multilayer construction is manufactured by injection molding, the mold is generally provided, at positions located near the north and south poles 61 and 61 and aligned with dimples, with a plurality of support pins for holding a golf ball inner layer, typically a core, in place within the spherical cavity. Since the use of the above-described dimple arrangement results in a degradation of the point symmetry of dimple arrangement with respect to the center of the golf ball as described above, the positions of support pins are not in register between upper and lower mold halves. This negates the share of common parts and needs an accordingly increased expense.

Where a seamless array of dimples at the position of equator 63 is employed, the parting planes of upper and lower mold halves must be alternately corrugated or raised for mutual engagement. This engagement configuration cannot be arrived at by simply shifting upper and lower mold halves.

SUMMARY OF THE INVENTION

Therefore, an object of the present invention is to provide a dimple arrangement method for golf balls so that the ball may have an esthetic outer appearance and excellent aerodynamic symmetry due to the improved symmetry of dimple arrangement, and the expense of golf ball manufacture involving injection molding may be reduced due to the improved point symmetry of dimple arrangement with respect to the golf ball center. Another object is to provide a golf ball manufactured in accordance with the dimple arrangement method.

Geometrically described, a golf ball defines a ball center and a spherical surface having a pair of poles and an equator, by which the ball is divided into a pair of hemispheres, and an axis passing the poles and the ball center. A plurality of imaginary lines connecting one pole and the equator and extending perpendicular to the equator are drawn on one hemisphere to equally divide the hemispherical surface into a plurality of spherical isosceles triangle regions. The inventor has discovered that once a number of dimples are arranged substantially equally within each spherical isosceles triangle region, the position of dimples is tailored using the axis as a reference whereby the resulting golf ball satisfies in good compromise the symmetry of dimple arrangement on the golf ball surface, the point symmetry of dimple arrangement with respect to the ball center, and the esthetic appearance of the ball.

The present invention provides a method for arranging dimples on a golf ball, comprising the steps of:

previously drawing a plurality of imaginary lines connecting one pole and the equator and extending perpendicular to the equator on one hemisphere to equally divide the hemispherical surface into a plurality of spherical isosceles triangle regions, arranging a number of dimples within spherical isosceles triangle regions adjoining along one imaginary line such that the dimples in the triangle regions are in axial symmetry with respect to the imaginary line, rotationally moving the arranged dimples about the axis in one direction such that those dimples arranged in an area relatively close to the pole are moved a substantially zero or very short distance, and those dimples arranged closer to the equator are moved a longer distance, and arranging dimples on the other hemisphere such that they are in point symmetry with the dimples as moved on the one hemisphere with respect to the ball center.

In a preferred embodiment, for each hemisphere, an even number of, most preferably 30, dimples are arranged adjacent to the equator and along a circumference. Also preferably, some of the dimples arranged adjacent to the equator lie across the equator. The distance which is rotationally moved is preferably such that the dimples adjacent to the equator on the opposite hemispheres are alternately arranged with respect to the equator.

A golf ball having dimples arranged on its spherical surface by the above method is also contemplated.

The golf ball having dimples arranged according to the method of the invention has the improved symmetry of dimple arrangement which affords high aerodynamic symmetry to the ball in flight.

When a golf ball is manufactured by injection molding, the injection mold consists of upper and lower mold halves which define a spherical cavity therein and have a parting plane corresponding to the equator of the spherical cavity. The mold is provided near the poles with support pins for holding a core in place within the spherical cavity. The support pins are located at the positions corresponding to those shaded dimples 1*s*, 2*s*, 3*s* and 4*s* depicted by hatching and designated with suffix "s" in FIGS. 1, 4, 6 and 8. The tip of the support pin also serves to form a dimple at the position with suffix "s" during injection molding. Since the position of a dimple with suffix "s" in FIG. 3 is within the range (angle $\gamma$) where the movement of dimples is not necessarily needed, symmetry can be maintained between upper and lower mold halves at the positions where support pins are located, enabling to use common parts for both mold halves. This avoids any increase of the expense required in the implementation of the invention.

DESCRIPTION OF THE PREFERRED EMBODIMENTS

Referring to FIGS. 1 to 9, several embodiments of the invention are described.

Figure 1:
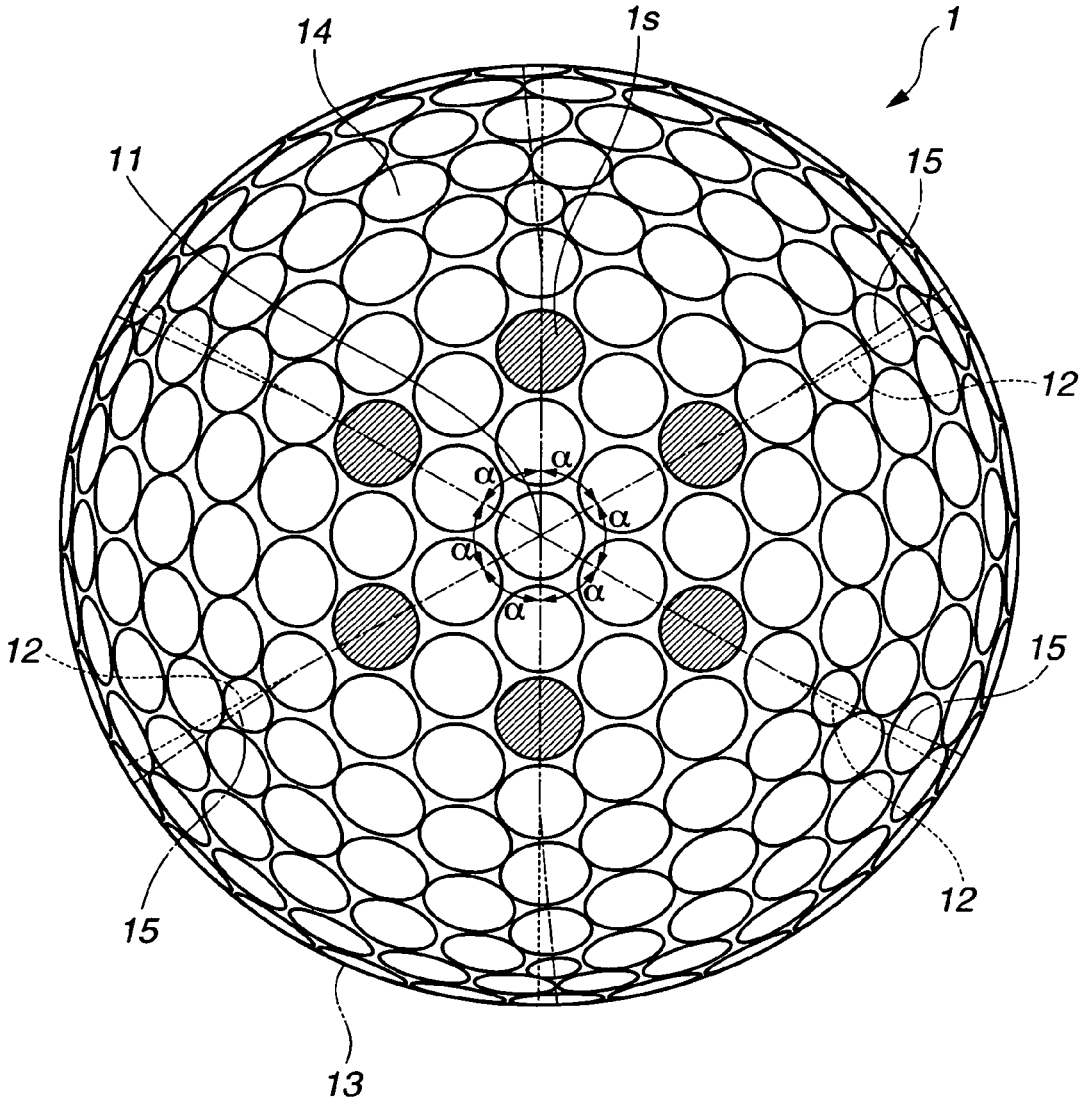
FIG. 1 is a plan view of a golf ball having dimples in a first embodiment of the invention, as viewed from above one pole.
Figure 2:
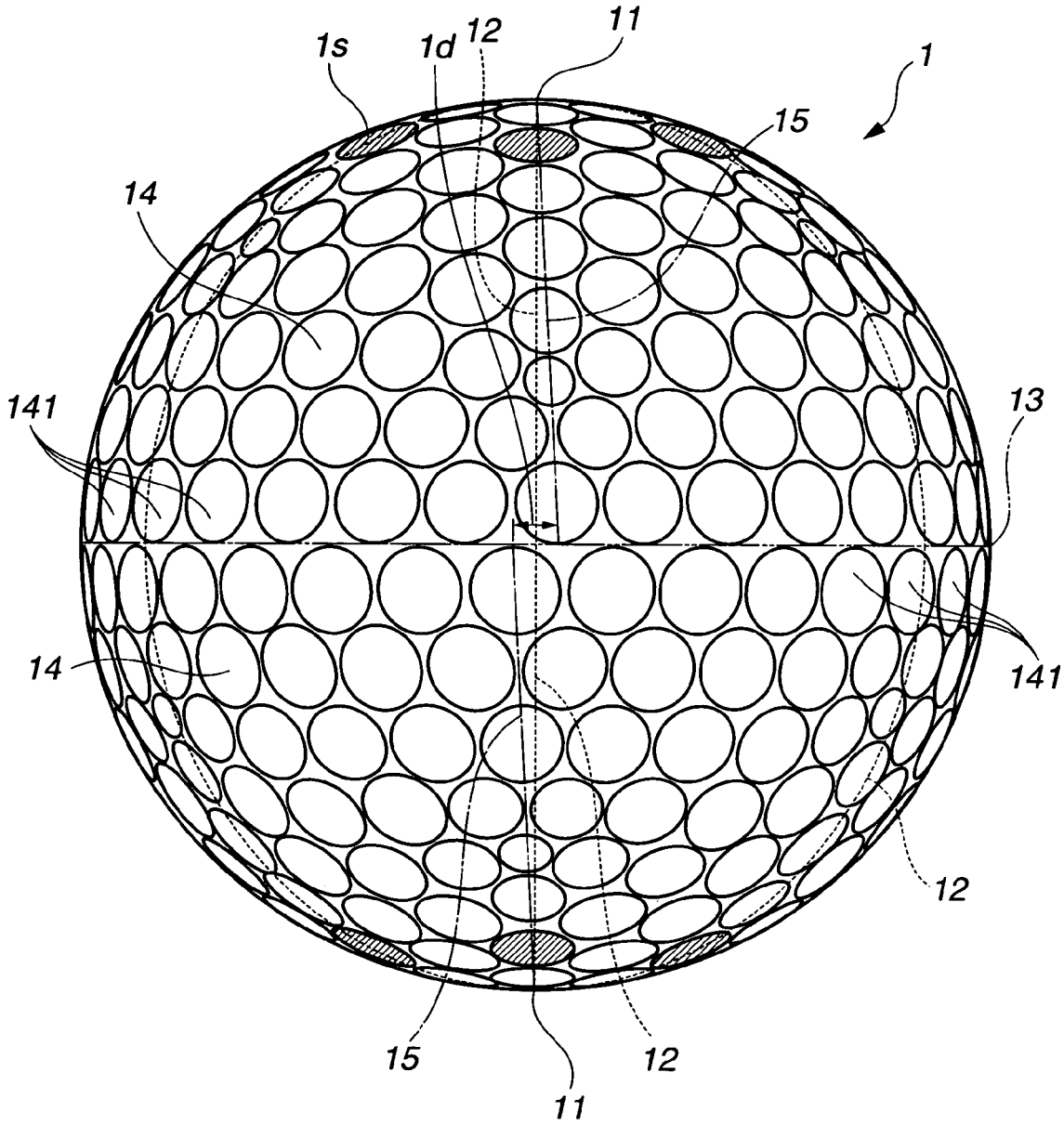
FIG. 2 is an elevational view of the ball of FIG. 1, as viewed from above the equator.
Figure 3:
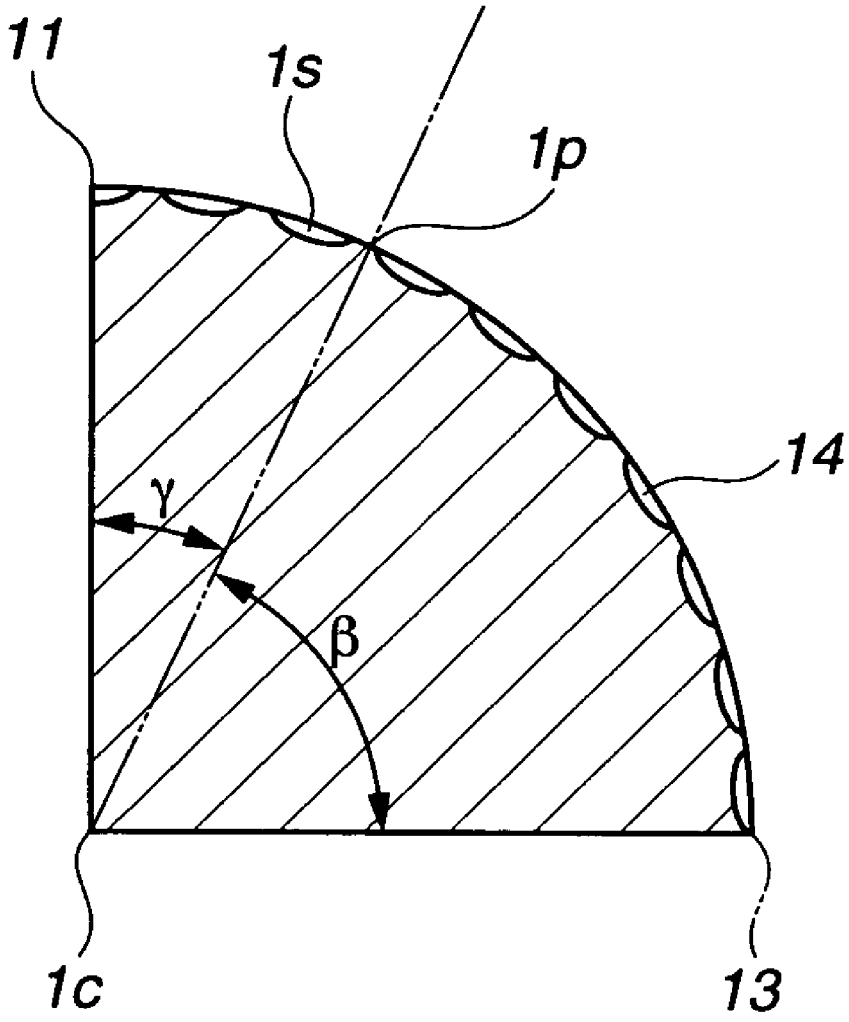
FIG. 3 illustrates a quadrant cross section of the golf ball of FIG. 1, taken at the ball center.

FIGS. 1 and 2 are plan and elevational views of a golf ball 1 having dimples in a first embodiment of the invention, as viewed from above one pole and the equator, respectively. FIG. 3 illustrates a quadrant cross section of the golf ball, taken at the ball center.

Geometrically described, the golf ball 1 defines a ball center 1*c* and a spherical surface having a pair of poles 11 and an equator 13, by which the ball is divided into a pair of hemispheres, and an axis passing the poles 11 and the ball center 1*c*. A plurality of imaginary lines 12 connecting one pole 11 and the equator 13 and extending perpendicular to the equator 13 are drawn on one hemisphere to equally divide the hemispherical surface into a plurality of spherical isosceles triangle regions (in the illustrated embodiment, six lines 12 are drawn to divide the hemispherical surface into six isosceles triangle regions). A number of dimples 14 are arranged within each spherical isosceles triangle region. On the opposed hemisphere with respect to the equator, imaginary lines 12 are drawn to divide the hemispherical surface into spherical isosceles triangle regions, and dimples 14 are arranged within each region in substantially the same manner.

In the golf ball 1, six equidistantly spaced imaginary lines 12 extend from one pole 11 to the equator 13 on the spherical surface. The angle included between each pair of imaginary lines which are disposed adjacent with respect to the pole 11 is depicted as $\alpha$ (=60°). The number of imaginary lines which can be drawn herein, though not particularly limited, is typically at least three, but up to twelve. Too many imaginary lines can impose substantial restraint on the shape of a position where a dimple is located whereas too few imaginary lines may lower the symmetry of dimple arrangement. The angle included between adjacent imaginary lines is appropriately determined by the number of imaginary lines. From the standpoint of increasing the symmetry of dimple arrangement on the golf ball surface, the angle is equally set to 360°/N wherein N is the number of imaginary lines.

Based on the above-described geometrical setting, the dimple arrangement method of the invention involves the steps of (1) arranging a number of dimples within spherical isosceles triangle regions on one hemispherical surface, (2) rotationally moving the arranged dimples about the axis in one direction by a predetermined angle for re-arranging the dimples, and (3) arranging dimples on the other hemispherical surface using the dimple arrangement on the one hemispherical surface as a reference. More specifically, the dimple arrangement method of the invention involves the steps of:

(1) arranging a number of dimples 14 within spherical isosceles triangle regions adjoining along one imaginary line 12 such that the dimples in the triangle regions are in axial symmetry with respect to the imaginary line 12, (2) rotationally moving the arranged dimples 14 about the axis in one direction such that those dimples arranged in an area relatively close to the pole 11 are moved a substantially zero or very short distance, and those dimples arranged closer to the equator 13 are moved a longer distance, and (3) arranging dimples 14 on the other hemisphere such that they are in point symmetry with the dimples 14 as moved on the one hemisphere with respect to the ball center 1*c*.

In step (1), dimples 14 are arranged within a spherical isosceles triangle region which is defined by two imaginary lines 12, 12 that include an angle of 120° (=2α) with respect to the pole 11 and the equator 13 on one hemisphere of the golf ball 1 (the spherical isosceles triangle region corresponding to a region equal to the sum of two spherical isosceles triangle regions adjoining each other and sharing the pole 11 among twelve, in total for both hemispheres, spherical isosceles triangle regions defined by six imaginary lines 12 and the equator 13). It is understood that three spherical isosceles triangle regions are defined on each of hemispheres of the golf ball 1.

In the illustrated embodiment, a plurality of dimples 14 of three types which differ in diameter are arranged within each spherical isosceles triangle region. Dimples are arranged within spherical isosceles triangle regions adjoining along one imaginary line 12 (or sharing one imaginary line 12) such that the dimples in the triangle regions are in axial symmetry with respect to the imaginary line 12, prior to the rearrangement of dimples in step (2).

Step (2) is to rearrange the dimples following step (1). The dimples 14 once arranged in step (1) are rotationally moved about the axis in one direction such that those dimples arranged in an area relatively close to the pole 11 are moved a substantially zero or very short distance, and those dimples arranged closer to the equator 13 are moved a longer distance.

In the golf ball 1 illustrated in FIGS. 1 and 2, the dimple 14 situated at the pole 11 is considered as the first one, and then the dimple situated as the third one along the imaginary line 12 is depicted as a hatched dimple 1*s*. With respect to nineteen (19) dimples 14 included in an area extending from the first dimple to the third dimples 1*s*, that is, a hexagonal area having the pole 11 as the barycenter and six dimples 1*s* as apexes, they remain unchanged from the arrangement state of step (1). That is, these dimples do not belong to the group of dimples which should be rearranged in position by step (2). In contrast, those dimples 14 which are disposed outside the hexagonal area are rearranged in one direction (rotated counterclockwise as viewed from above the pole 11). The amount of rotational movement becomes greater as the longitudinal position approaches closer to the equator 13 from the dimple 1*s*.

The rearrangement of dimples on the golf ball 1 will be better understood by comparing the original imaginary line and a rearrangement center line. Note that when the dimples are moved from the situation where the dimples place their center on the (original) imaginary line 12 prior to the rearrangement, by the rearrangement step (2), a rearrangement center line 15 is drawn by connecting the centers of the moved dimples. In FIGS. 1 and 2, the original imaginary line 12 is depicted as a broken line and the rearrangement center line 15 is depicted as a dot-and-dash line. The rearrangement center line 15 is adjoined by and spaced apart from the imaginary line 12 so that the spacing between the lines 15 and 12 gradually increases in a direction approaching to the equator 13. Within the hexagonal area having the pole 11 as the barycenter and six dimples 1*s* as apexes, the rearrangement center line 15 is aligned with the imaginary line 12.

FIG. 3 illustrates in cross section a quadrant of the golf ball, centered at the ball center 1*c* and spreading between the equator 13 and the pole 11. A boundary point 1*p* is where the rearrangement center line 15 starts to deviate from the imaginary line 12. An angle β is a range between two line segments extending from the ball center 1*c* to opposite ends of an arc which extends along the imaginary line 12 from the boundary point 1*p* to the equator 13. An angle γ is a range between two line segments extending from the ball center 1*c* to opposite ends of an arc which extends along the imaginary line 12 from the boundary point 1*p* to the pole 11. That is, β+γ=90°. In a preferred embodiment, the angle γ is up to 25°, more preferably up to 24°, even more preferably up to 23°. The value of γ may even be 0°, but it is desired in this case that the distance of movement of those dimples situated in a region extending from the pole to 23-25° be significantly smaller than the distance of movement of those dimples situated in an equator-sided region corresponding to an angle β of 65-67°. If γ has a value of more than 25°, it becomes difficult to arrange dimples such that the dimples as moved on one hemisphere and the dimples on the other hemisphere are in point symmetry with respect to the ball center.

In the golf ball 1, as shown in FIG. 2, the rotational movement of dimples about the axis (passing the ball center and the pole) as an axis of rotation on one hemisphere delimited by the equator 13 is counter to the rotational movement of dimples on the other hemisphere. As a result, the rearrangement center line 15 on one hemisphere is shifted from the rearrangement center line 15 on the other hemisphere by a distance 1*d* along the equator 13. In the golf ball 1, this distance 1*d* is set so that the dimples 141 of the first rows close to the equator on opposed hemispheres are juxtaposed alternately or in zigzag on opposite sides of the equator. The equator zone where the dimples 141 of the first row close to the equator on one hemisphere are juxtaposed alternately or in zigzag with the dimples 141 of the first row close to the equator on the other hemisphere is preferred for improving the outer appearance of the golf ball. In the illustrated golf ball 1, the dimples 141 of the first row close to the equator on each hemisphere do not extend beyond the equator, but remain inside and in substantial tangential contact with the equator.

The number of dimples in the first row close to the equator on each hemisphere is typically at least 24, but up to 36 (an even number), though not particularly limited. In the illustrated embodiment, the number of dimples in the first row is 30 on each hemisphere.

In connection with step (2), the rearrangement center line 15 extends curvilinear on the golf ball 1. The movement of dimples so as to give such curvilinear center lines is preferred for maintaining the symmetry of dimple arrangement and preventing being degraded from the aerodynamic symmetry.

Step (3) is to arrange dimples 14 on the other hemisphere such that they are in point symmetry with the dimples 14 as moved on the one hemisphere with respect to the ball center 1*c*. Using as a basis the dimple arrangement which has been tailored by step (2), dimples are arranged on the other hemispherical surface where no dimples have been arranged. Past step (3), the dimples 14 are arranged over the entire spherical surface of the golf ball, ensuring the point symmetry of dimple arrangement with respect to the ball center and eventually, reducing the expense of golf ball manufacture during injection molding.

As a result of arranging dimples in the above-described way, the positional relationship between spherical isosceles triangle regions which are used as a reference for dimple arrangement on the golf ball 1 is such that a spherical isosceles triangle on one hemisphere and a corresponding spherical isosceles triangle on the other hemisphere are 60° phase shifted about the axis (passing the poles).

In the illustrated embodiment, the total number of dimples formed on the spherical surface of the golf ball 1 is 356, including 284 dimples with a diameter 4.2 mm and a depth 0.137 mm, 60 dimples with a diameter 3.7 mm and a depth 0.13 mm, and 12 dimples with a diameter 2.6 mm and a depth 0.12 mm. Generally the total number of dimples formed on the spherical surface of the golf ball is at least 200, and preferably at least 250, but up to 500, and preferably up to 450. If the total number of dimples on the spherical surface is less than 200 or more than 500, the flight performance of the ball may be adversely affected. The number of dimple types used is generally 2 to 20 types, and preferably 3 to 10 types, though not particularly limited.

Figure 4:
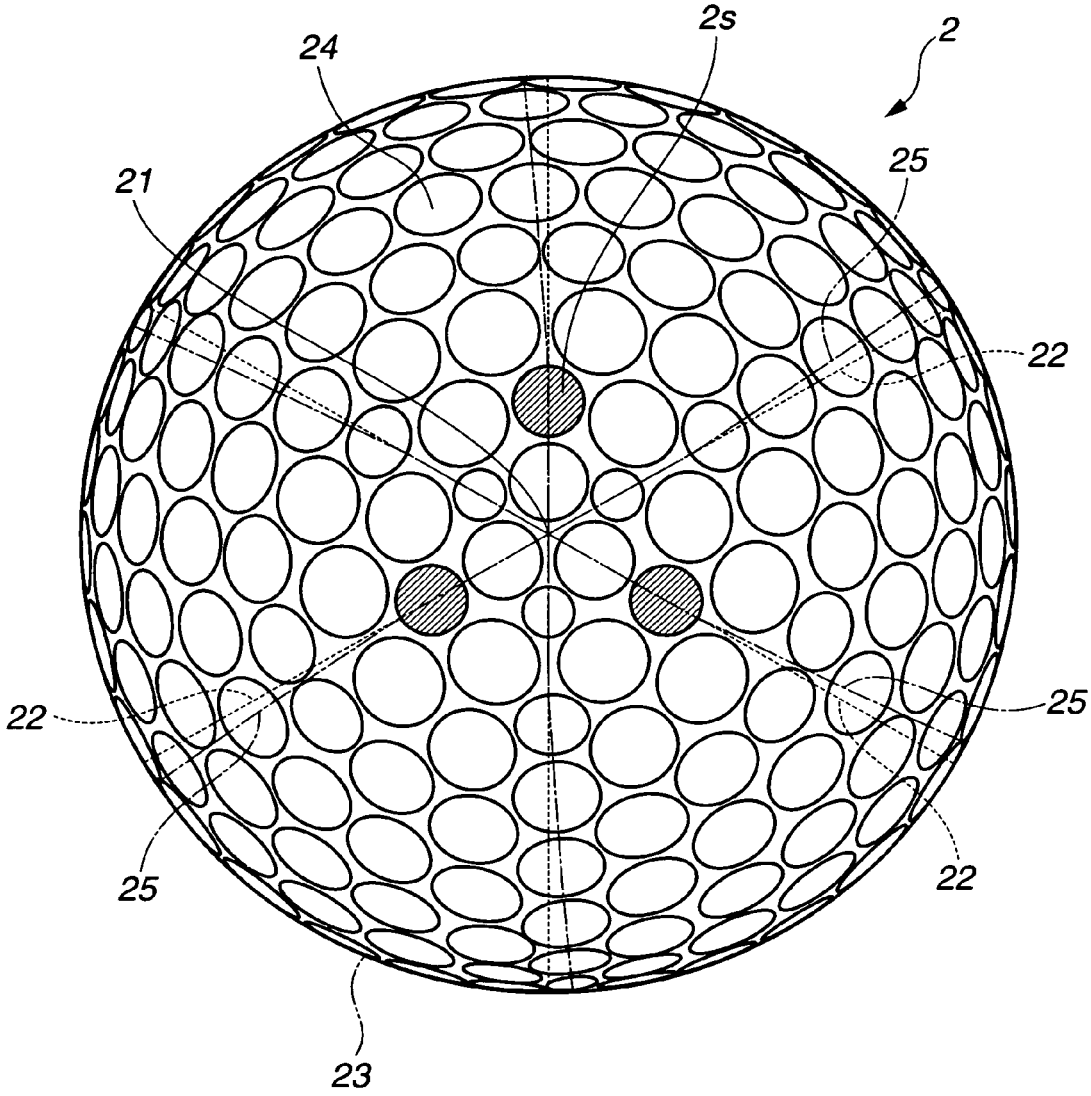
FIGS. 4 and 5 are plan and elevational views of a golf ball having dimples in a second embodiment of the invention, as viewed from above one pole and the equator, respectively.
Figure 5:
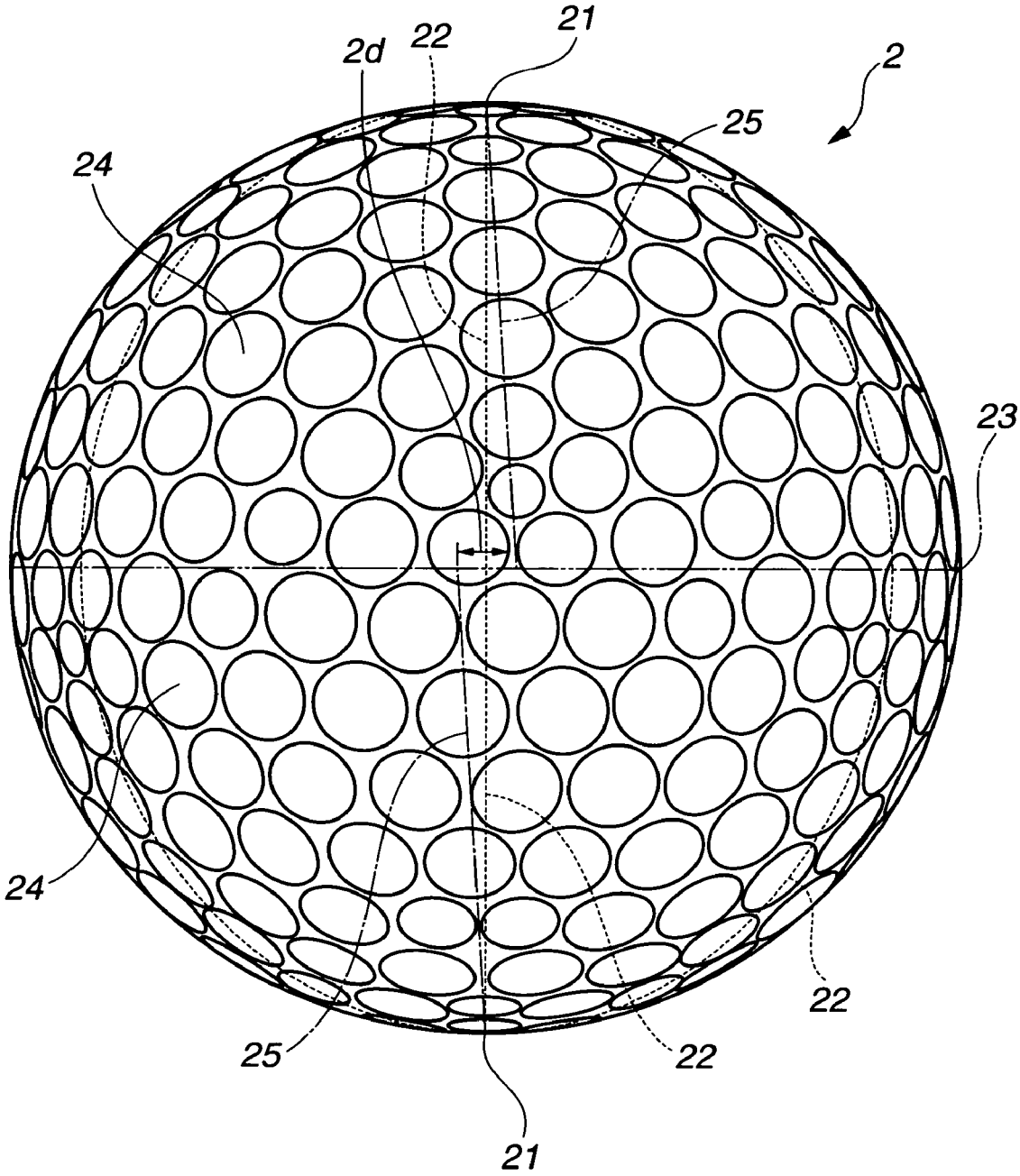

FIGS. 4 and 5 are plan and elevational views of a golf ball 2 having dimples in a second embodiment of the invention, as viewed from above one pole and the equator, respectively.

The golf ball 2 differs from the golf ball 1 of the first embodiment in that the total number of dimples formed on the spherical surface is 330, including 12 dimples with a diameter 4.6 mm and a depth 0.145 mm, 234 dimples with a diameter 4.4 mm and a depth 0.14 mm, 60 dimples with a diameter 3.8 mm and a depth 0.14 mm, 6 dimples with a diameter 3.5 mm and a depth 0.15 mm, 6 dimples with a diameter 3.4 mm and a depth 0.13 mm, and 12 dimples with a diameter 2.6 mm and a depth 0.10 mm. The number of dimples arranged on the first row close to the equator is 30, which is identical with that on the golf ball 1, but among them, four dimples 24 that lie across the equator 23 on each hemisphere are intermittently disposed in the first row of dimples and alternately on the opposite hemispheres and along the equator, providing a seamless arrangement. The remaining components are the same as in the golf ball 1.

Figure 6:
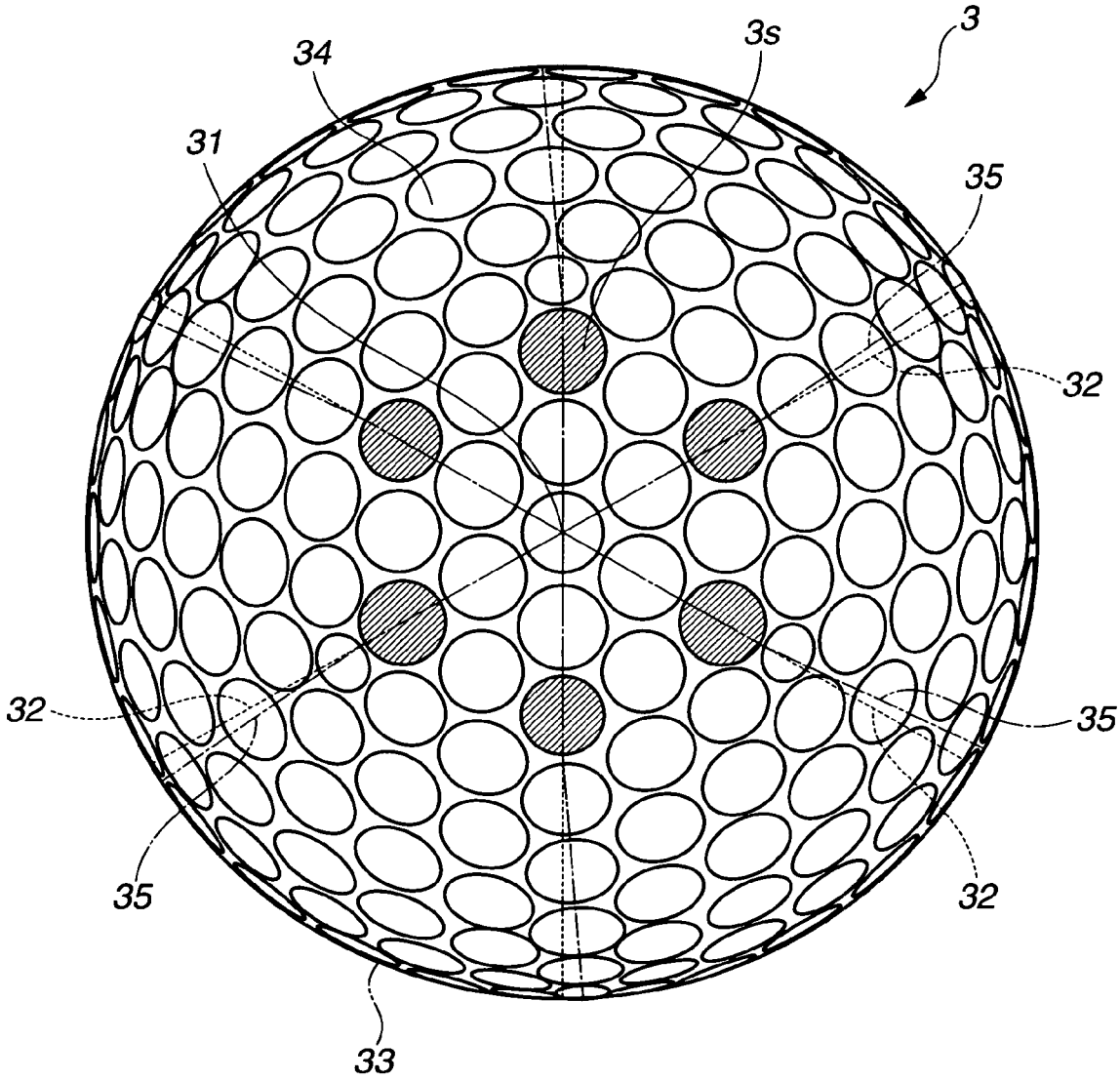
FIGS. 6 and 7 are plan and elevational views of a golf ball having dimples in a third embodiment of the invention, as viewed from above one pole and the equator, respectively.
Figure 7:
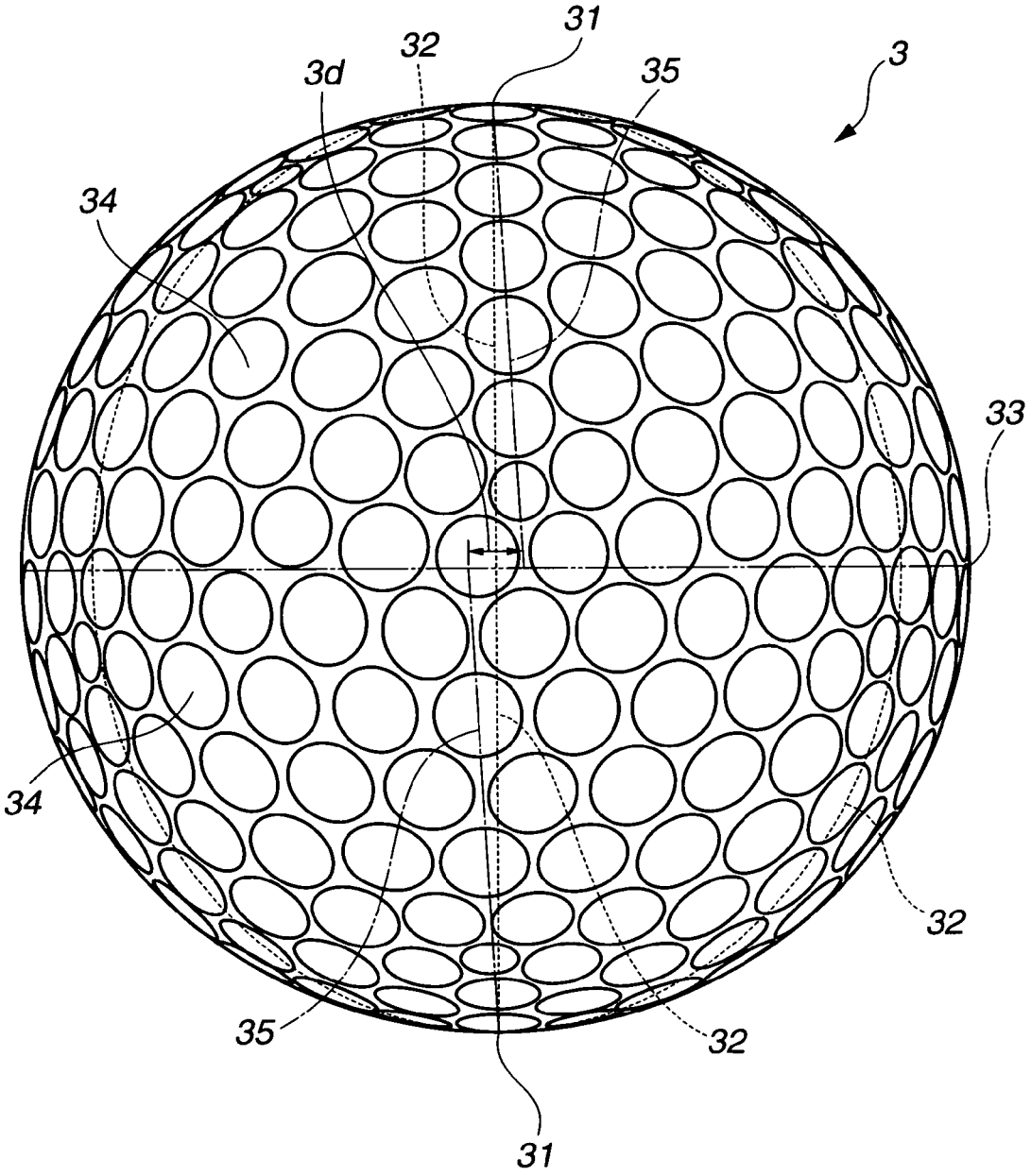

FIGS. 6 and 7 are plan and elevational views of a golf ball 3 having dimples in a third embodiment of the invention, as viewed from above one pole and the equator, respectively.

The golf ball 3 differs from the golf ball 1 of the first embodiment in that the total number of dimples formed on the spherical surface is 338, including 234 dimples with a diameter 4.25 mm and a depth 0.14 mm, 12 dimples with a diameter 4.1 mm and a depth 0.16 mm, 80 dimples with a diameter 3.9 mm and a depth 0.14 mm, and 12 dimples with a diameter 2.7 mm and a depth 0.1 mm. The number of dimples arranged on the first row close to the equator is 30, which is identical with that on the golf ball 1, but among them, four dimples 34 that lie across the equator 33 on each hemisphere are intermittently disposed in the first row of dimples and alternately on the opposite hemispheres and along the equator, providing a seamless arrangement. The remaining components are the same as in the golf ball 1.

Figure 8:
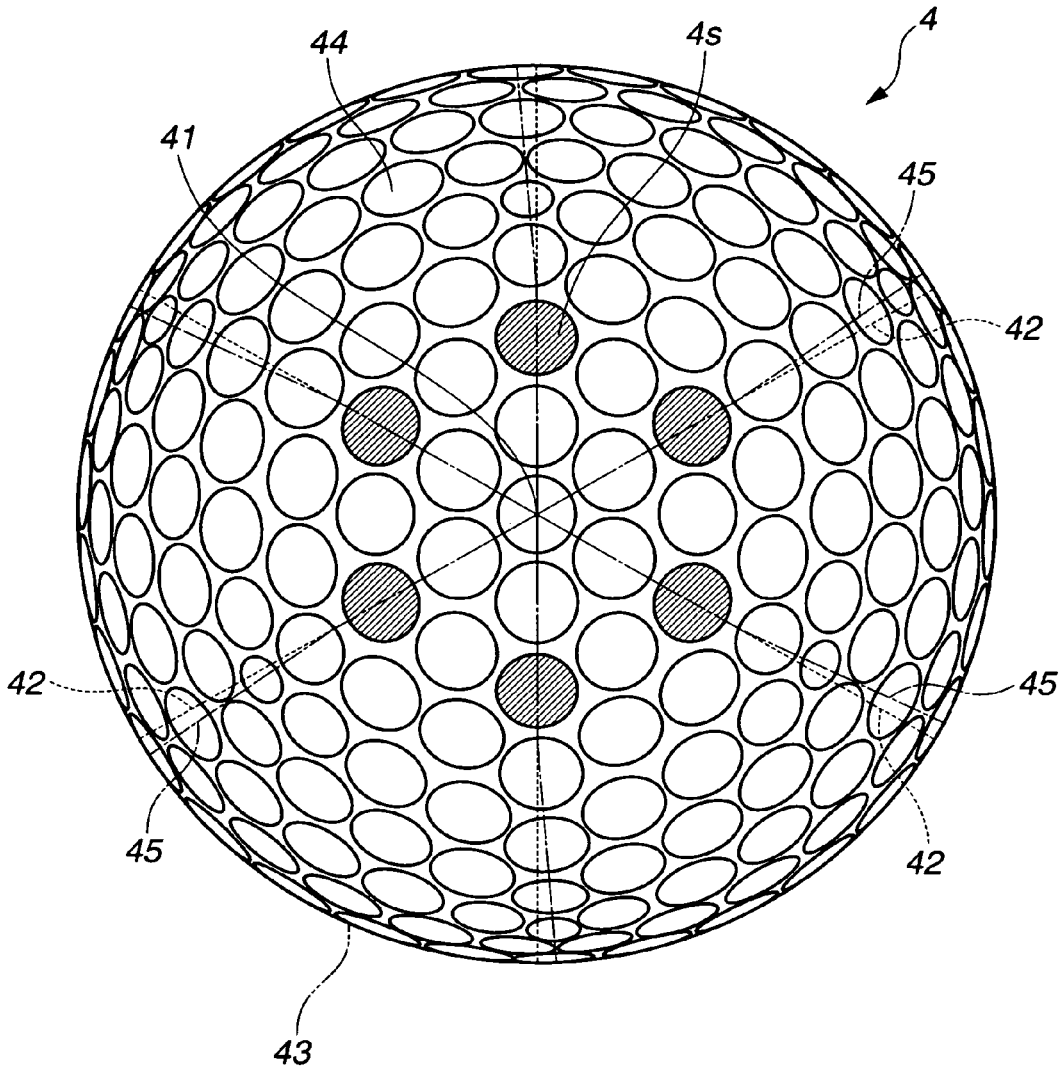
FIGS. 8 and 9 are plan and elevational views of a golf ball having dimples in a fourth embodiment of the invention, as viewed from above one pole and the equator, respectively.
Figure 9:
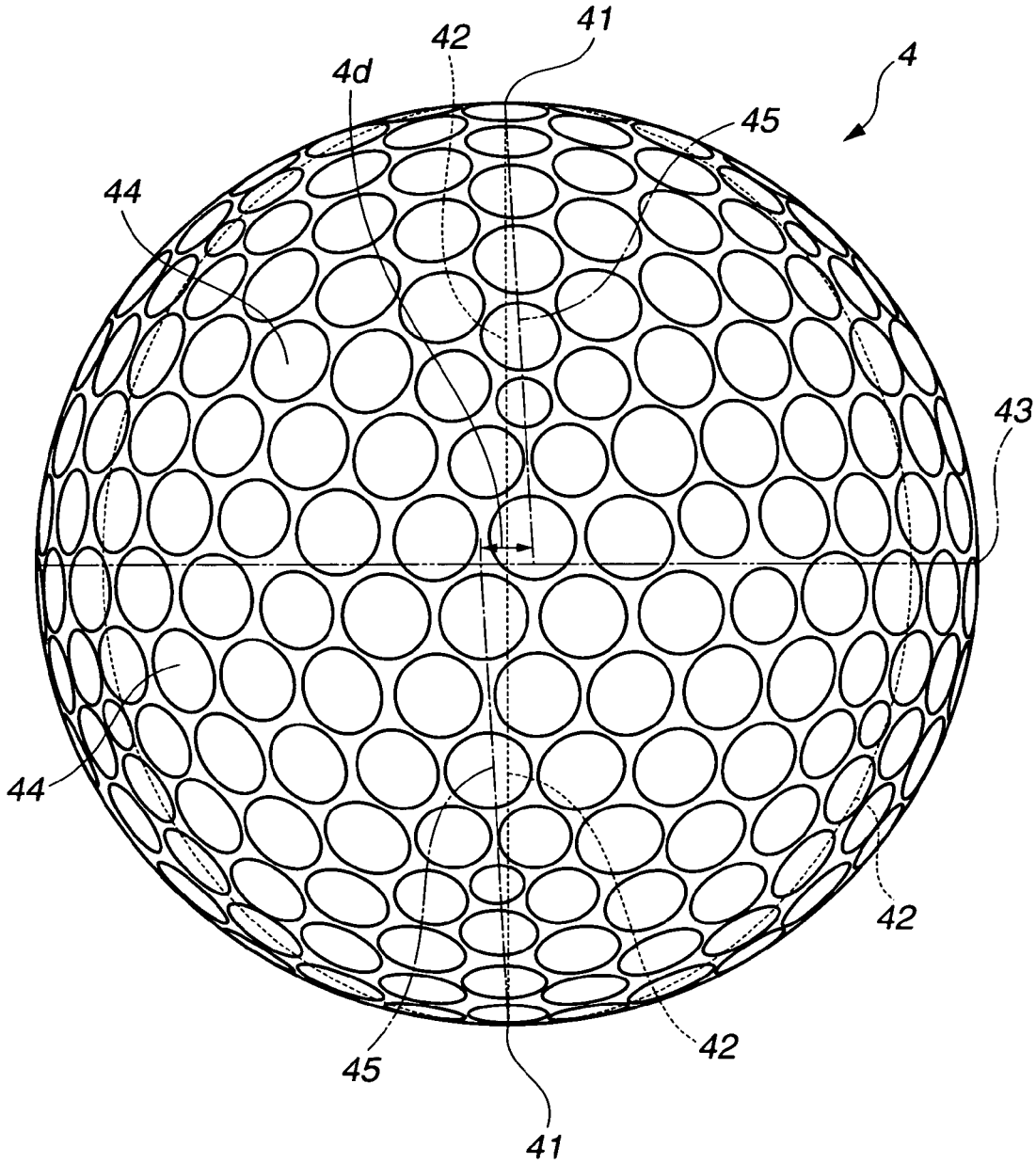
Figure 10:
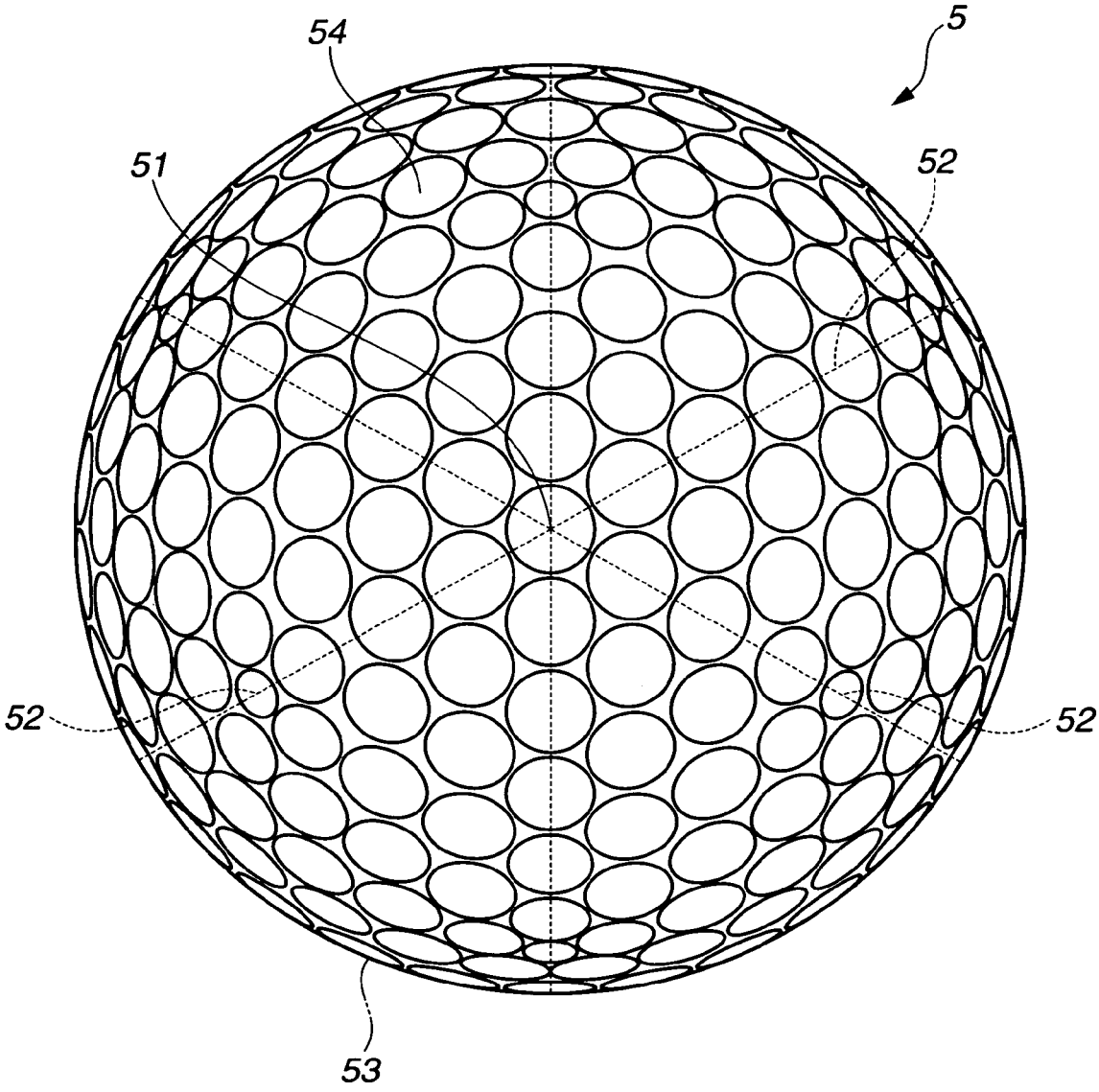
FIG. 10 is a plan view of a prior art golf ball having dimples of polyhedral arrangement, as viewed from above one pole.
Figure 11:
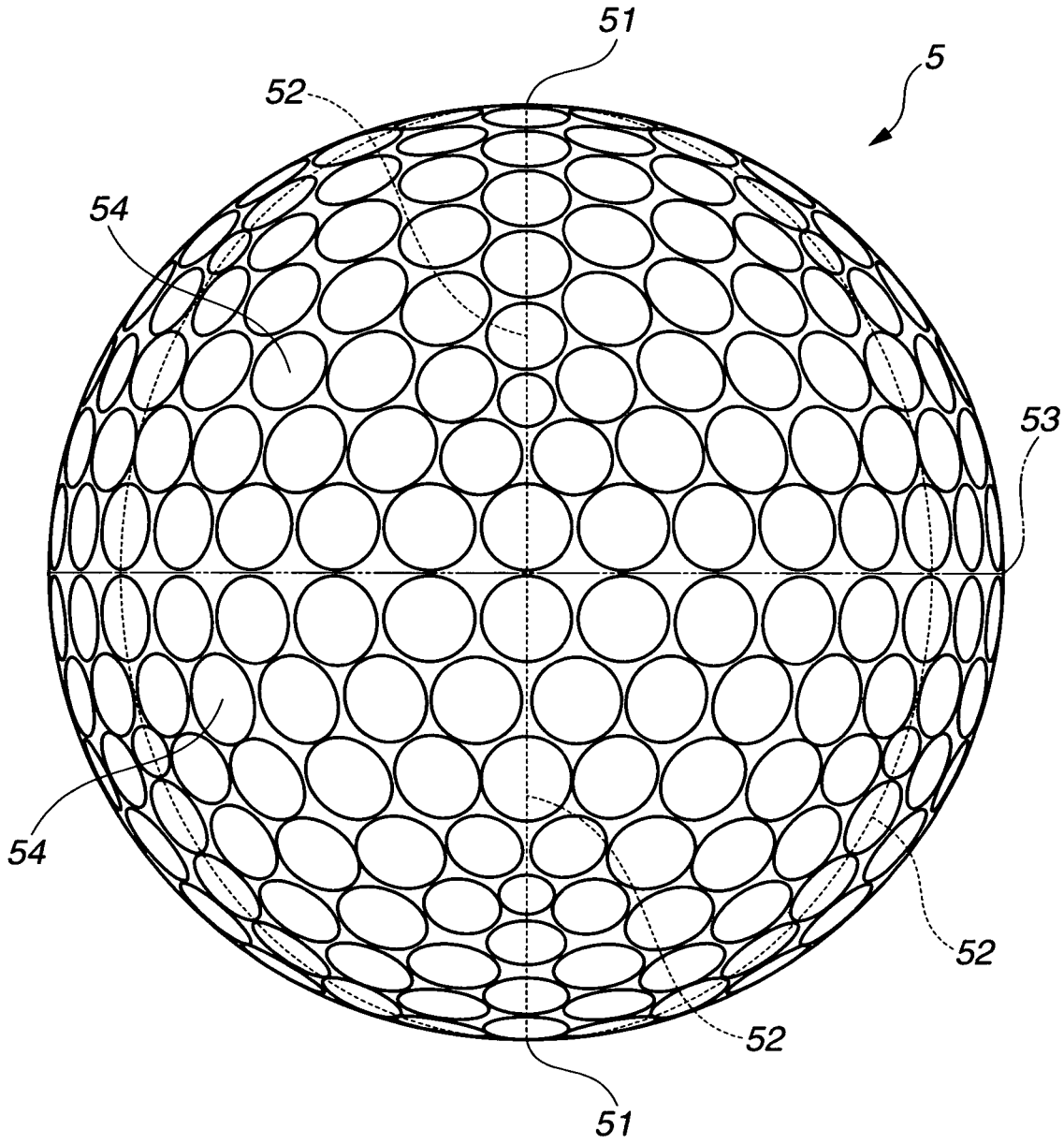
FIG. 11 is an elevational view of the ball of FIG. 10, as viewed from above the equator.
Figure 12:
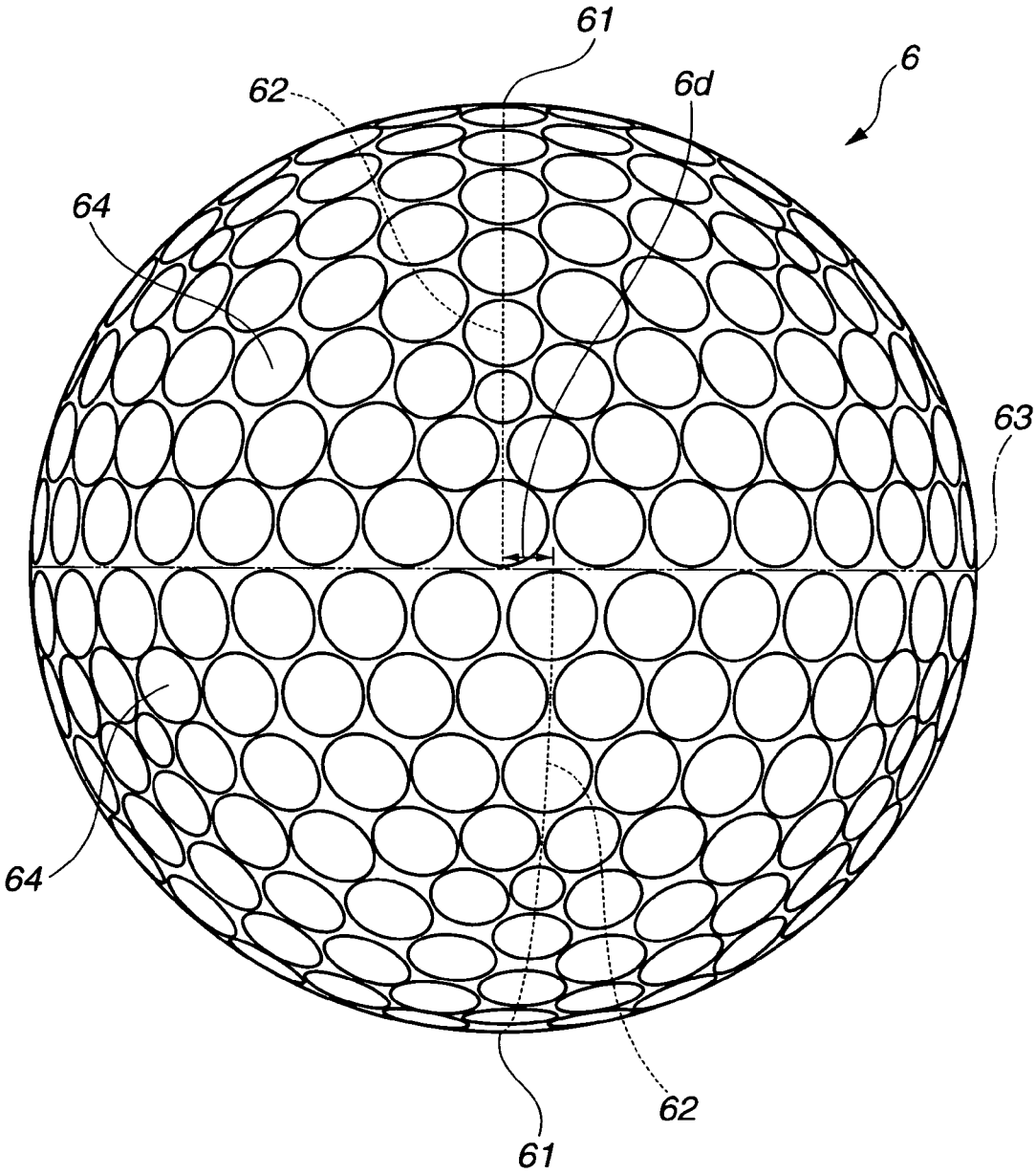
FIG. 12 is an elevational view of a prior art golf ball having dimples of modified polyhedral arrangement, as viewed from above the equator.

FIGS. 8 and 9 are plan and elevational views of a golf ball 4 having dimples in a fourth embodiment of the invention, as viewed from above one pole and the equator, respectively.

The golf ball 4 differs from the golf ball 1 of the first embodiment in that the total number of dimples formed on the spherical surface is 356, including 258 dimples with a diameter 4.2 mm and a depth 0.137 mm, 12 dimples with a diameter 4.1 mm and a depth 0.15 mm, 2 dimples with a diameter 3.9 mm and a depth 0.15 mm, 72 dimples with a diameter 3.7 mm and a depth 0.135 mm, and 12 dimples with a diameter 2.6 mm and a depth 0.12 mm. The number of dimples arranged on the first row close to the equator is 30, which is identical with that on the golf ball 1, but among them, four dimples 44 that lie across the equator 43 on each hemisphere are intermittently disposed in the first row of dimples and alternately on the opposite hemispheres and along the equator, providing a seamless arrangement. The remaining components are the same as in the golf ball 1.

The shape of the dimples as viewed from above or in plane may be any of circular shapes, elliptic shapes, convex polygonal shapes (including regular convex polygonal shapes) such as triangular, quadrangular, and pentagonal shapes, and concave polygonal shapes (including regular concave polygonal shapes) such as star shapes, though not limited thereto. The shape of the dimples as viewed in depth direction or in radial cross section may have a curved surface which is convex toward the ball center or configured to have a flat bottom, though is not limited thereto.

The maximum depth of the dimples as measured from an extension of the spherical surface is generally 0.05 to 0.4 mm, preferably 0.1 to 0.25 mm, though not limited thereto. If the maximum depth is too small or too large, the golf ball may be degraded in aerodynamic performance, resulting in a shorter carry.

Those dimples which are arranged circumferentially and adjacent to the equator, like the dimples 141 (FIG. 2), more specifically those dimples in at least one pair of rows among the pairs of first, second and third rows on opposite sides of the equator have a depth which may be 0.005 to 0.03 mm greater than the depth of those dimples which are disposed in other areas, but have the same diameter. On the other hand, those dimples which are arranged in proximity to the opposed poles, specifically in areas with an angle $\gamma$ (FIG. 3) of less than 30° have a depth which may be 0.005 to 0.03 mm less than the depth of those dimples which are disposed in other areas, but have the same diameter. By adjusting the depth of dimples disposed in proximity to the equator and/or the opposed poles in this way, the aerodynamic symmetry of the golf ball in flight can be further improved.

The total of the volumes of dimples distributed over the entire spherical surface is preferably 400 to 650 $mm^3$, more preferably 450 to 600 $mm^3$.

A mold used in molding of the inventive golf balls may be prepared by using 3D CAD-CAM and by such methods as direct and three-dimensional machining of a reversal master model to develop an entire surface shape, or direct and three-dimensional machining of a mold block to form a cavity.

Although some preferred embodiments have been described, many modifications and variations may be made thereto in light of the above teachings. It is therefore to be understood that the invention may be practiced otherwise than as specifically described without departing from the scope of the appended claims.

Japanese Patent Application No. 2003-289840 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A method for arranging dimples on a golf ball, the golf ball geometrically defining a ball center and a spherical surface having a pair of poles and an equator, by which the ball is divided into a pair of hemispheres, and an axis passing the poles and the ball center, the method comprising the steps of:

drawing a plurality of imaginary lines connecting one pole and the equator and extending perpendicular to the equator on one hemisphere to divide the hemispherical surface into a plurality of spherical isosceles triangle regions, arranging a plurality of dimples within spherical isosceles triangle regions adjoining along one imaginary line of the imaginary lines such that the dimples in the triangle regions are in axial symmetry with respect to said one imaginary line, rotating the dimples about the axis such that the dimples arranged close to the pole are rotated about a smaller angle than are the dimples arranged closer to the equator;

wherein some of the dimples arranged adjacent to the equator lie across the equator.

2. The dimple arrangement method of claim 1, further comprising arranging dimples on the other hemisphere such that they are in point symmetry with the dimples on the one hemisphere with respect to the ball center.

3. The dimple arrangement method of claim 1, wherein for each hemisphere, an even number of dimples are arranged adjacent to the equator and along a circumference.

4. The dimple arrangement method of claim 1, wherein for each hemisphere, 30 dimples are arranged adjacent to the equator.

* * * * *